US005842584A

United States Patent [19]

Baird

[11] Patent Number: 5,842,584

[45] Date of Patent: Dec. 1, 1998

[54] STRAP-ON DRILL PARAPHERNALIA HOLDING SYSTEM AND METHOD

[76] Inventor: Daniel Wallace Baird, 5835 Sullivantown Rd., Walkertown, N.C. 27051

[21] Appl. No.: 779,404

[22] Filed: Jan. 7, 1997

Related U.S. Application Data

[60] Provisional application No. 60/010,519 Jan. 24, 1996 and provisional apllication No. 60/029,808 Oct. 25, 1996.

[51] Int. Cl.[6] ..... A47F 7/00

[52] U.S. Cl. ..... 211/69.1; 211/70.6; 224/223; 224/901.4; 206/379; 383/39; 24/17 B

[58] Field of Search ..... 211/69.1, 70.6; 248/205.2; 224/223, 904, 901.4; 206/379, 372; 383/39; 24/17 B, 306

[56] References Cited

U.S. PATENT DOCUMENTS

| | | | |
|---|---|---|---|
| 4,408,707 | 10/1983 | Rogers | 224/239 |
| 4,508,221 | 4/1985 | Olson | 206/379 |
| 4,598,822 | 7/1986 | Hemmings | 206/379 |
| 4,714,096 | 12/1987 | Guay | 139/391 |
| 4,773,576 | 9/1988 | Moravek | 224/191 |
| 4,797,040 | 1/1989 | Hibbard | 408/241 |
| 4,804,121 | 2/1989 | Stanton | 224/191 |
| 4,988,338 | 1/1991 | Taylor et al. | 248/205.2 |
| 5,199,621 | 4/1993 | McLennan | 224/253 |
| 5,365,609 | 11/1994 | Herzog | 2/161.4 |
| 5,544,396 | 8/1996 | Mekyska | 24/523 |
| 5,544,747 | 8/1996 | Horn | 206/378 |
| 5,600,854 | 2/1997 | Henrekin | 24/197 |
| 5,664,673 | 9/1997 | Perry | 248/205.2 |

*Primary Examiner*—Peter M. Cuomo
*Assistant Examiner*—Anthony D. Barfield

[57] ABSTRACT

A belt for storing elongated articles and a method for forming the same. The belt attaches to a planar surface or to a power tool, and includes a pad sewn to a strap. The pad includes a two-ply hook-and-loop fastener and an elastic member. The elastic member urges the two hook-and-loop plies into engagement, and the elongated article can be stored between the two hook-and-loop plies. The elastic member and the first hook-and-loop ply are gathered relative to the second hook-and-loop ply. The method includes laterally sewing the elastic member to the first hook-and-loop ply, cutting the first hook-and-loop ply, stretching the elastic member, longitudinally sewing the elastic member to the first hook-and-loop ply while the former is stretched, laterally sewing the elastic member and the first hook-and-loop ply to the second hook-and-loop ply to form the pad, and sewing the pad to the strap to form the belt. The longitudinal sewing gathers the elastic member and the first hook-and-loop ply into a plurality of sleeves, which store elongated items.

19 Claims, 4 Drawing Sheets

STRAP-ON DRILL PARAPHERNALIA HOLDING SYSTEM AND METHOD

This application claims the benefit of U.S. Provisional Application Serial No. 60/010,519, filed 24 Jan. 1996, and U.S. Provisional Application 60/029,808, filed 25 Oct. 1996.

BACKGROUND OF THE INVENTION

1. Field of the Invention

The invention herein pertains to the secure storage of accessories and paraphernalia associated with power tools on a belt. The invention also pertains to the secure storage of elongated items such as toothbrushes, combs, or hair brushes in a travel setting, or such as thermometers, depressors, or other elongated devices in a hospital setting, with the use of a specially designed belt.

2. Description of Related Art and Objectives of the Invention

The secure storage of elongated items has been a problem for many years, leading to much expenditure of inventive effort. Especially acute are the problems of storing accessories for power tools such as electric drills, saws, and drivers. These accessories include blades, cutting bits, driver bits, and chuck keys. Often, these accessories are relatively small and thus easy to misplace. However, these small accessories are critical to the performance of the power tool, so they must be stored securely while still allowing ready access.

Users of power tools often store these accessories in the power tool's original package, but this approach fails if the package is missing, destroyed, or otherwise rendered inoperative. Worse yet, some users simply throw these accessories into a large toolbox, where they can be lost or damaged.

The art has addressed these shortcomings in the storage of elongated accessories by providing several devices. Although these devices are improvements, they frequently rely upon elastic members to retain the elongated articles. These elastic members suffer from several shortcomings, including the tendency of elastic material to lose its elasticity over time and heavy use, the inability of these devices to accommodate elongated articles of substantially different thicknesses, and the reliance of these devices solely upon the elastic to retain the elongated article.

Thus, there exists a continuing need in the art for an elongated article holder that is more durable and more effective and versatile than an elastic holder. The instant invention meets this need by providing a holder in the form of a belt that uses both a hook-and-loop fastener and an elastic member to hold elongated articles. The elongated article is placed between the two plies of the hook-and-loop fastener, and the elastic member urges the two plies into engagement, so that the elongated article is held securely by the two hook-and-loop plies. When the elongated article is withdrawn from the holder, the elastic member forces the two plies into even closer engagement, thus providing a "self-closing" feature. Because the elongated article is positioned between two plies of conventional hook-and-loop material such as Velcro™, the elastic is substantially protected from any sharp edges on the elongated article. As an alternative, "one-wrap" hook-and-loop material may be used when appropriate herein having a "hook" ply on one side and a "loop" ply on the other side.

A first objective of the instant invention is to provide a belt-type holder that uses both elastic materials and hook-and-loop fasteners to secure the elongated articles.

A second objective is to provide a belt-type holder for elongated articles that comprises a pad and a strap, and the pad further comprises a hook-and-loop fastener whose two plies are urged into engagement by an elastic member, thereby providing the holder with a "self-closing" capability.

A third objective is to provide a method for forming a belt-type holder for elongated articles that comprises the steps of sewing a hook-and-loop fastener to an elastic member, cutting the hook-and-loop fastener, stretching the elastic member, and sewing the hook-and-loop fastener to the elastic member, while the latter remains stretched.

A fourth objective is to provide a belt-type holder to be secured to a power tool for holding the paraphernalia associated with that power tool.

A fifth objective is to provide a method for forming a belt-type holder to be secured to a power tool for holding the paraphernalia associated with that power tool.

A sixth objective of the present invention is to provide a belt-type holder for a drill or other tool which includes a ring for suspending the drill during storage.

A seventh objective of the invention provides secure holding of multiple objects in various sizes in a single sleeve due to the combined properties of the elastic and the hook and loop material.

Various other objectives and advantages of the present invention will become apparent to those skilled in the art as a more detailed description is set forth below.

SUMMARY OF THE INVENTION

The aforesaid and other objectives are met by providing a belt holder, and a method for forming the same. The belt comprises a pad sewn to a strap. The pad comprises three elongated members: an elastic member, a first hook-and-loop ply, and a second hook-and-loop ply. The elastic member urges the first and second hook-and-loop plies into engagement, and an article can be stored between the two hook-and-loop plies. Also, the elastic member and the first hook-and-loop ply are gathered relative to the second hook-and-loop ply; this gathering provides a sleeve into which the elongated article can be placed.

The pad is formed by first sewing the elastic member to the first hook-and-loop ply with a plurality of lateral stitches perpendicular to the length of the elastic member. The first hook-and-loop ply is then cut transversely to produce a plurality of shorter hook-and-loop segments. The elastic member is stretched and while stretched, the elastic member is sewn to the plurality of hook-and-loop segments continuously along only one longitudinal edge. The elastic member is then allowed to recover. Because the elastic member and the plurality of hook-and-loop segments are sewn together along only one longitudinal edge, that sewn edge of the elastic member tends to maintain its extended length while the unsewn edge relaxes to its original length. As a result, the sewn edge of the elastic member and the hook-and-loop segments "gather", "box" "flare" or "bunch" along the sewn edge. The bunched elastic and first hook-and-loop ply is then sewn to a second hook-and-loop ply along the lateral stitches to form the pad with sleeves therealong. The flared edges form funnel-like openings that facilitate insertion of elongated articles into the sleeves. The pad is then suitable for mounting to a rigid surface or strap for encircling the housing of a power tool.

An alternative embodiment comprises an elastic member sewn under tension along one side to "gather", "bow" or "bunch" that side when the elastic member is relaxed. The "gathered" elastic defines a plurality of flared openings which, when attached to a base form sleeves into which articles may be stored. This embodiment omits the hook-and-loop plies and sews the "gathered" elastic member directly to an elongated strap.

DETAILED DESCRIPTION OF THE PREFERRED EMBODIMENTS AND OPERATION OF THE INVENTION

Figure 1:
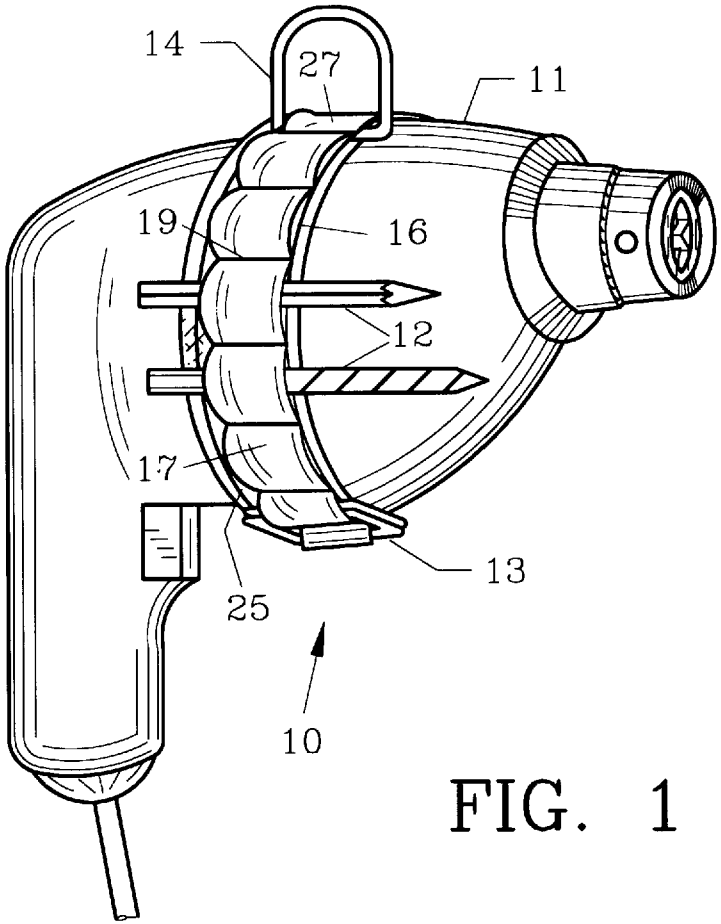
FIG. 1 is a perspective view of the preferred embodiment of the apparatus of the invention attached to a drill.

FIG. 1 is a perspective view of the preferred embodiment of the invention, belt 10, shown attached to drill 11. Belt 10 comprises strap 25, pad 27, D-ring 14, and double metal loop 13.

Strap 25 is an adjustable circular strap that may comprise leather, rubber, nylon, plastic, vinyl, hook-and-loop material, or other rugged components. Strap 25 provides a base for pad 27, and can be solid as shown in FIG. 1, or can be perforated to allow air flow through the strap to cool the drill motor. The underside of strap 25 (against drill 11) has non-slip material sewn or otherwise attached. Strap 25 has double D-ring 13, or another fastening device such as a buckle, attached to one end. Strap 25 is passed around drill 11, pulled tight through double D-ring 13, and secured by second hook-and-loop fastener 26. D-ring 14 is attached to strap 25 and allows drill 11 to be hung from a nail, hook or screw for storage in a shop or on the jobsite. Pad 27 is bunched or gathered to define a plurality of sleeves 16 to hold elongated articles 12. Pad 27 is preferably narrower than strap 25, thereby facilitating insertion of elongated articles 12 into sleeves 16.

Figure 2:
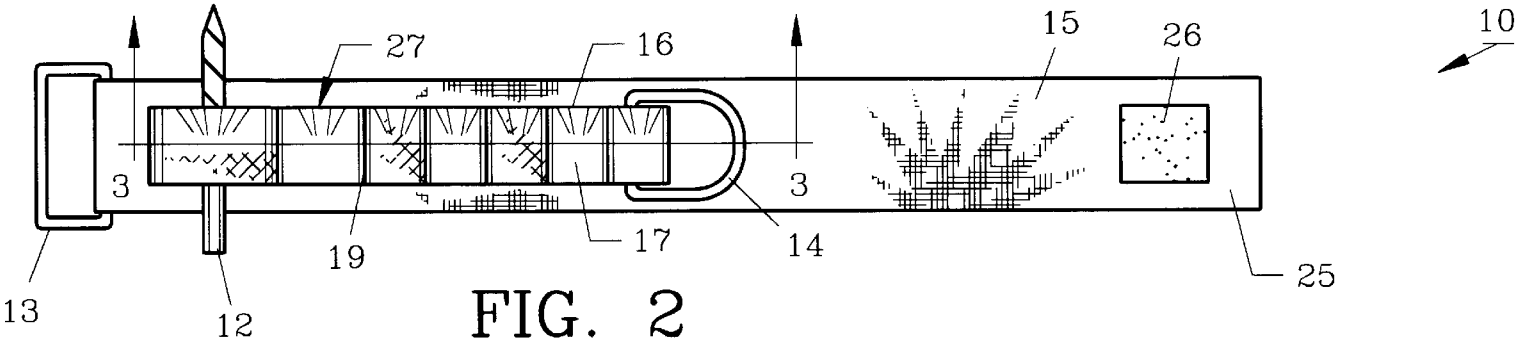
FIG. 2 is a top plan view of the preferred embodiment removed from the drill and laid flat.
Figure 3:
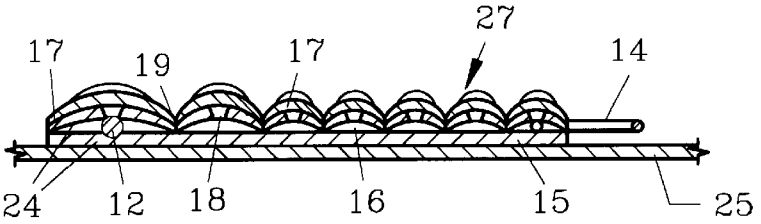
FIG. 3 is a sectional view taken along the line 3—3 in FIG. 2.

FIG. 2 is a top plan view of the preferred embodiment removed from drill 11 and laid flat, and FIG. 3 is a cross-section of the preferred embodiment taken along the line 3—3 in FIG. 2. Pad 27 is affixed to strap 25 by direct sewing, by adhesives, by hook-and-loop fasteners, or by any other secure attachment method. Pad 27 comprises three layers: elastic strap 17, first hook-and-loop ply 18, and second hook-and-loop ply 15. First hook-and-loop ply 18 and second hook-and-loop ply 15 taken as a whole comprise first hook-and-loop fastener 24. Alternatively, strap 25 may be omitted, and second hook-and-loop ply 15 may be used to encircle drill 11.

Elastic strap 17 forms the upper-most exposed layer of pad 27. The length of elastic strap 17 approximates the length of pad 27. First hook-and-loop ply 18 is sewn to elastic strap 17 along lateral stitches 19. Lateral stitches 19 partition pad 27 into a plurality of sleeves 16 that securely hold elongated articles 12, which may be drill bits or other power tool accessories. Elastic strap 17 and first hook-and-loop ply 18 are gathered or bunched, then are sewn to second hook-and-loop ply 15. The method of gathering or bunching elastic strap 17 and first hook-and-loop ply 18 are described in more detail below. Second hook-and-loop ply 15 is approximately the same length as elastic strap 17. First hook-and-loop ply 18 should be complementary to second hook-and-loop ply 15; e.g., if a hook ply is used for the first ply, then a loop ply should be used for the second ply.

The distance between lateral stitches 19, and thus the width of sleeves 16, is varied to allow storage of elongated articles 12 having different thicknesses in a given sleeve 16. First hook-and-loop ply 18 and second hook-and-loop ply 15 not only increase the holding strength of elastic strap 17, but also protect elastic strap 17 from being damaged by elongated articles 12, which may be sharp drill bits, as they are pushed and pulled through sleeves 16.

Because first hook-and-loop ply 18 is sandwiched between second hook-and-loop ply 15 and elastic strap 17, first hook-and-loop ply 18 is urged into engagement with second hook-and-loop ply 15 to hold securely elongated article 12. Thus, elongated article 12 is held not only by elastic strap 17, but also by hook-and-loop plies 15 and 18. When elongated article 12 is withdrawn from sleeve 16, elastic strap 17 relaxes and urges first hook-and-loop ply 18 and second hook-and-loop ply 15 into even closer engagement, thus allowing sleeves 16 to "self-close".

Figure 4A:
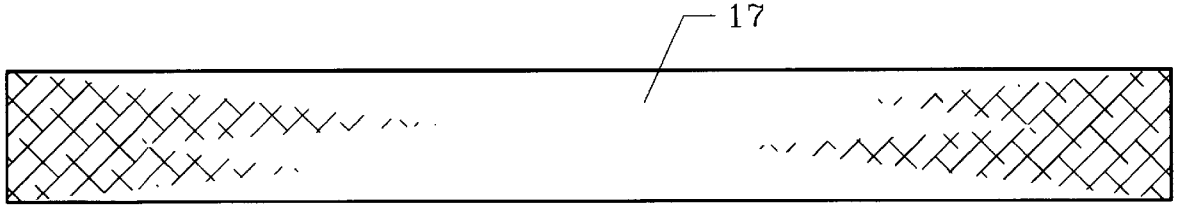
FIGS. 4A–4F are top plan views illustrating the preferred method of forming the apparatus of the invention.
Figure 4B:
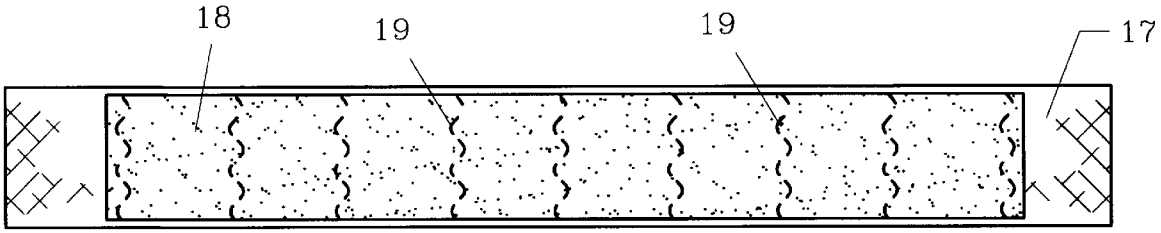

FIGS. 4A–4F illustrate the preferred method of forming pad 27 for belt 10. FIG. 4A illustrates an elongated section of elastic strap 17. In FIG. 4B, an elongated section of first hook-and-loop ply 18 is centered upon elastic strap 17 with the hook-and-loop side of first hook-and-loop ply 18 exposed. First hook-and-loop ply 18 is then sewn to elastic strap 17 with a plurality of lateral stitches 19, which are perpendicular to the length of elastic strap 17. Lateral stitches 19 partition pad 27 into a plurality of sleeves 16 (shown in FIGS. 2 and 3.

Figure 4C:
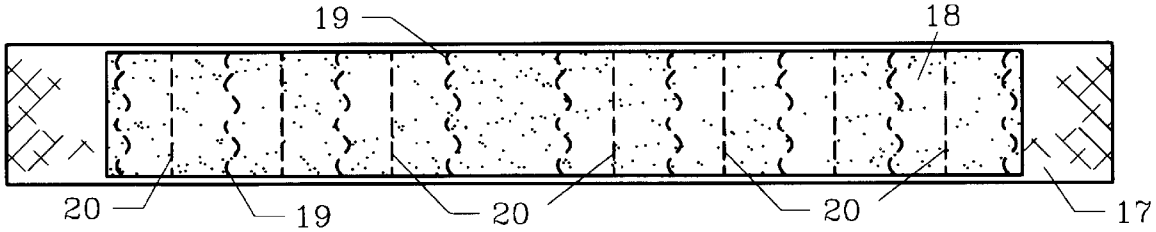

Next, in FIG. 4C, first hook-and-loop ply 18 is cut along a plurality of cut lines 20 at the center of each sleeve 16. Cut lines 20 sever first hook-and-loop ply 18 into a plurality of shorter segments 22.

Figure 4D:
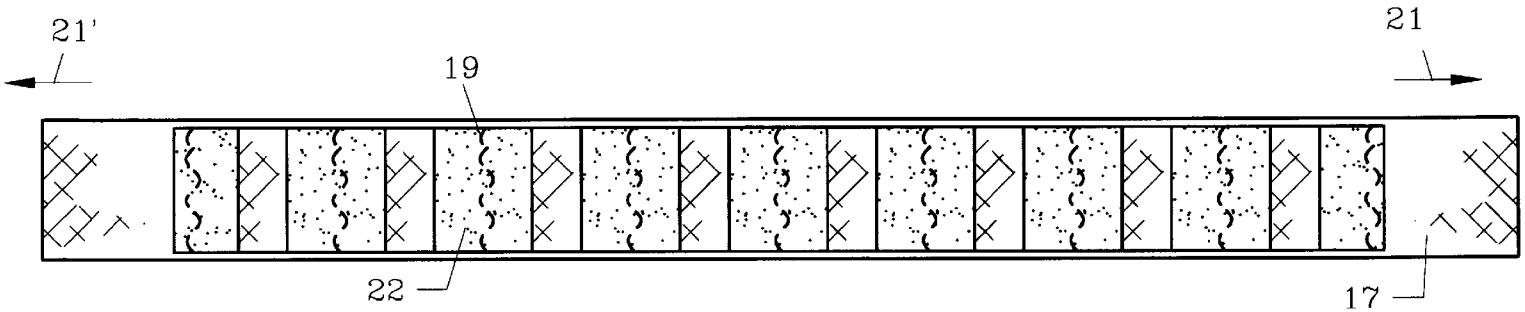

Next, in FIG. 4D, elastic strap 17 is stretched lengthwise in the directions shown by arrows 21 and 21, thereby elongating elastic strap 17 and separating segments 22. Lateral stitches 19 affix the centers of segments 22 relative to elastic strap 17.

Figure 4E:
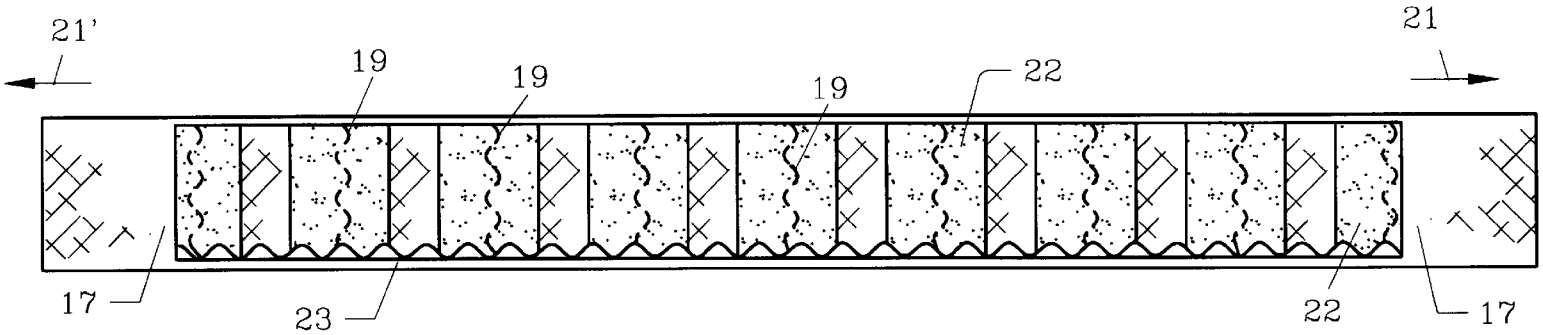

In FIG. 4E, elastic strap 17 is held elongated while longitudinal stitches 23 are sewn into one edge of elastic strap 17. Longitudinal stitches 23 affix elastic strap 17 to the plurality of segments 22 along one longitudinal edge of elastic strap 17. The other longitudinal edge of strap 17 is left free or unsewn.

Figure 4F:
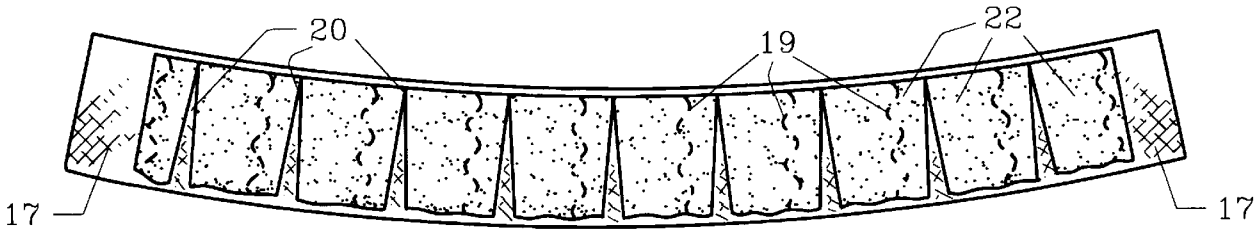

Finally, in FIG. 4F, elastic strap 17 is released and allowed to relax to its original, unstretched length. The unsewn longitudinal edge relaxes to nearly its original length; however, the sewn longitudinal edge cannot relax appreciably because it was sewn to segments 22 while elongated. Longitudinal stitches 23 provide means for preventing elastic strap 17 from contracting. Elastic strap 17 and the plurality of segments 22 comprising first hook-and-loop ply 18 "bunch" or "gather" along the sewn longitudinal edge. Pad 27 is then completed by sewing elastic strap 17 and first hook-and-loop ply 18 to second hook-and-loop ply 15 along lateral stitches 19, thus maintaining sleeves 16. Pad 27 is then sewn to strap 25 to form belt 10.

Figure 5:
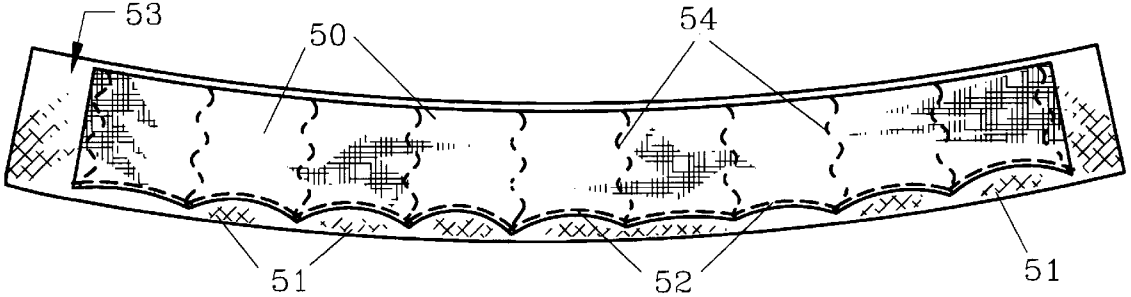
FIG. 5 is a top plan view of an alternate embodiment of the invention.

In an alternate embodiment shown in FIG. 5, first hook-and-loop ply 18 and second hook-and-loop ply 15 are omitted, and elastic member 50 is bunched to form a plurality of sleeves 51. Elastic member 50 is stretched, and stitches 52 are placed continuously along one longitudinal edge of elastic member 50 while the latter remains stretched.

When elastic member 50 is released, the sewn edge will "bunch" or "gather", thereby defining a plurality of sleeves 51. Elastic member 51 can then be attached by lateral stitches 54 to surface 53 to store elongated articles. Surface 53 might be a hospital cart or other base to store needles and syringes, or a toolbox to store drill bits and screwdrivers.

The illustrations and examples provided herein are for explanatory purposes and are not intended to limit the scope of the appended claims. For example, when the terms "hook and loop" plies are used herein those skilled in the art may also use hook and hook plies in certain instances.

I claim:

1. A belt for holding elongated items, said belt comprising:

(a) a first hook-and-loop ply;

(b) an elastic member, said elastic member attached to said first hook-and-loop ply; and (c) a second hook-and-loop ply attached to said first hook-and-loop ply, said first hook-and-loop ply and said elastic member defining a plurality of self-closing sleeves wherein said elastic member causes said first hook-and-loop ply to engage said second hook-and-loop ply thereby closing said sleeves upon extraction of received elongated items.

2. The belt of claim 1, wherein said first hook-and-loop ply, said second hook-and-loop ply and said elastic member comprise elongated straps.

3. The belt of claim 1, wherein said elastic member and the first hook-and-loop ply are attached along a longitudinal edge.

4. The belt of claim 1, wherein said elastic member and the first hook-and-loop ply are attached along a plurality of lateral lines.

5. The belt of claim 1, wherein the first hook-and-loop ply is narrower than the second hook-and-loop ply.

6. The belt of claim 1, wherein the first hook-and-loop ply comprises a plurality of hook-and-loop segments being shorter than said elastic member.

7. A belt for holding paraphernalia for a power tool, said belt comprising:

(a) a first hook-and-loop ply;

(b) an elastic member, said first hook-and-loop ply attached to said elastic member;

(c) a second hook-and-loop ply attached to said first hook-and-loop ply, said first hook-and-loop ply and said elastic member being gathered relative to said second hook-and-loop ply to define a sleeve for receiving the elongated items, wherein said elastic member causes said first hook-and-loop ply to engage said second hook-and-loop ply thereby closing said sleeve upon extraction of received elongated items; and (d) means for securing the belt to the power tool, said securing means attached to said second hook-and-loop ply.

8. The belt of claim 7, wherein said first hook-and-loop ply, said second hook-and-loop ply, and said elastic member comprise elongated straps.

9. The belt of claim 7, wherein said elastic member and the first hook-and-loop ply are each attached along one longitudinal edge.

10. The belt of claim 7, wherein said elastic member and the first hook-and-loop ply are attached along a plurality of lateral lines.

11. The belt of claim 7, wherein the first hook-and-loop ply is narrower than the second hook-and-loop ply.

12. The belt of claim 7, wherein the first hook-and-loop ply comprises a plurality of hook-and-loop segments each being shorter than said elastic member.

13. The belt of claim 7, wherein said securing means comprises a double D-ring.

14. A drill and belt in combination, said belt for holding elongated items, said belt comprising:

a) a strap;

b) a first hook-and-loop ply;

c) an elastic member, said first hook-and-loop ply attached to said elastic member along a longitudinal edge and a plurality of lateral lines; and d) a second hook-and-loop ply, said second hook-and-loop ply attached to said first hook-and-loop ply and to said elastic member to define a plurality of self-closing sleeves for receiving the elongated items;

said belt encircling said drill for holding the elongated items thereagainst whereby said elastic member forces said first hook-and-loop ply against said second hook-and-loop ply for engagement therebetween upon extraction of the received elongated items.

15. The combination of claim 14 further comprising a d-ring, said d-ring contiguous to said strap, said d-ring for hanging said combination.

16. The combination of claim 15 further comprising means to secure said belt to said drill, said securing means attached to said strap.

17. The combination of claim 16 wherein said securing means comprises a double d-ring.

18. The combination of claim 17 wherein said first hook-and-loop ply is narrower than said second hook-and-loop ply.

19. The combination of claim 18 wherein said first hook-and-loop ply comprises a plurality of hook-and-loop segments each being shorter than said elastic member.

* * * * *